United States Patent [19]

Gerke

[11] Patent Number: 4,580,870

[45] Date of Patent: Apr. 8, 1986

[54] TERMINAL ELEMENT FOR CABLE WIRES AND DROP WIRE CABLES

[75] Inventor: Dieter Gerke, Berlin, Fed. Rep. of Germany

[73] Assignee: KRONE GmbH, Berlin, Fed. Rep. of Germany

[21] Appl. No.: 734,770

[22] Filed: May 15, 1985

Related U.S. Application Data

[63] Continuation of Ser. No. 472,266, Mar. 4, 1983, abandoned.

[30] Foreign Application Priority Data

Apr. 22, 1982 [DE] Fed. Rep. of Germany ..... 3214896

[51] Int. Cl.[4] ..... H01R 11/22

[52] U.S. Cl. ..... 339/258 R; 339/277 R

[58] Field of Search ..... 339/97 R, 97 D, 98, 339/99 R, 258 R, 258 RR, 277 R

[56] References Cited

U.S. PATENT DOCUMENTS

| | | | |
|---|---|---|---|
| 3,950,062 | 4/1976 | Reavis, Jr. | 339/97 R |
| 4,116,522 | 9/1978 | Reynolds | 339/97 R |
| 4,141,618 | 2/1979 | Reavis, Jr. et al. | 339/97 P |
| 4,218,106 | 8/1980 | Belokin, Jr. | 339/32 R |
| 4,317,608 | 3/1982 | Dechelette | 339/99 R |

*Primary Examiner*—Gil Weidenfeld
*Assistant Examiner*—Paula A. Austin
*Attorney, Agent, or Firm*—Baker, Maxham & Jester

[57] ABSTRACT

The invention relates to a terminal element of leaf-shaped resilient contact material for making a solderless, non-screwed and non-stripping contact with a drop wire cable and a cable wire. The terminal element (1) comprises in the central region of a contact slot (2) a second slot (3) extending to left and right and having an overall inverted U-shape. Above the inverted U-slot (3) the contact slot (2) has a larger width for termination of the drop wire cable than beneath the mouth of the inverted U-slot (3), wherein the lower, narrower portion (2*a*) of the contact slot is used to terminate a cable wire.

4 Claims, 3 Drawing Figures

Fig.1
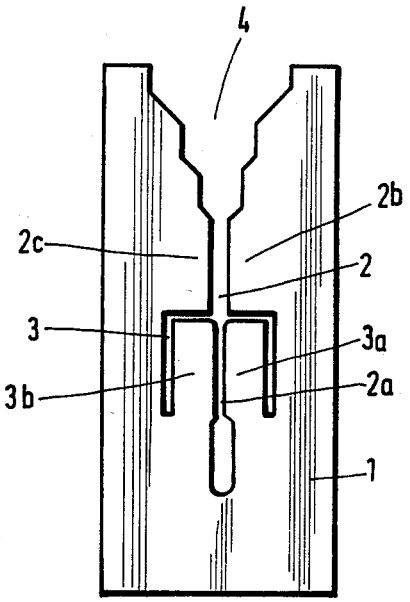
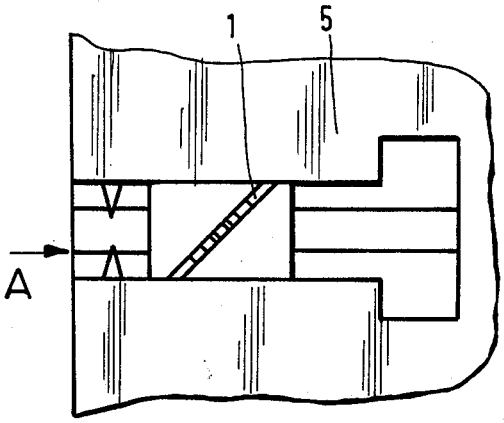
Fig.2
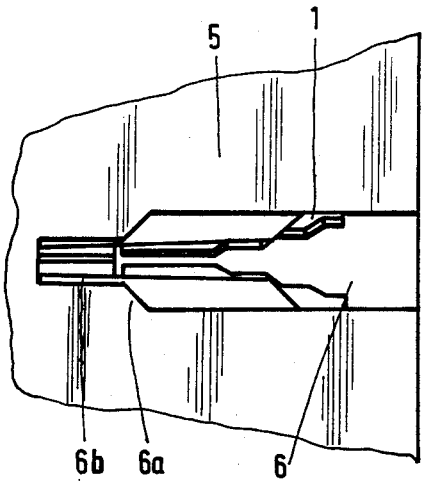
Fig.3

TERMINAL ELEMENT FOR CABLE WIRES AND DROP WIRE CABLES

This is a continuation of co-pending application Ser. No 472,266 filed on Mar. 4, 1983, abandoned.

The invention relates to a terminal element of leaf-shaped resilient contact material for making a solderless, non-screwed and non-stripping contact, particularly with polytropic air gap,—briefly LSA-PLUS contact (translator's note: LSA-PLUS contact originates from the German words löt-, schraub- und abisolierfreier Kontakt mit polytropem Luft-Spalt=solderless, non-screwed and non-stripping contact with polytropic air gap) including a contact slot with a cascade-like flared insertion opening.

Among the terminal elements used so far there are, for instance, screw-type attachments for drop wire cables which are difficult to strip, and separate termination points for cable wires or conductors.

The applicant has developed a termination technique for the solderless, non-screwed and non-stripping termination of insulated wires or conductors to contact terminals, and this technique has become widely accepted in the art under the designation LSA termination technique.

As is known from the DE-PS 2,610,416, this LSA termination technique employs upright contact terminals mounted in a terminal block and consisting of thin spring sheet material, said contact terminals defining an open longitudinal slot between two lateral resilient lugs.

The resilient lugs become offset relative to each other due to deformation when upon insertion of the conductor wire at an angle of 45° to the contact terminal the contact slot defining relatively sharp edges of the resilient lugs first sever the insulation and then penetrate by a predetermined distance into the conductor material, whereby the electrically conductive contact is made.

Thereby a permanently good contact is achieved by the torsional force of the two resilient lugs.

It is the object of the invention to provide—by employing the above-specified termination technique—a solderless, non-screwed and non-stripping terminal element for drop wire cables and cable wires.

The subject matter of the present invention which solves the above-specified object is a terminal element of leaf-shaped resilient contact material for making a solderless, non-screwed and non-stripping contact, comprising a contact slot with a cascade-like enlarged insertion opening, said terminal element being characterized in that it includes in the central region of the contact slot and extending therefrom a second slot of overall inverted U-shape, and that the contact slot above the inverted U-slot has a larger width, which is suitable for the termination of a drop wire cable, than the narrower contact slot portion formed beneath the inverted U-slot and suitable for termination of a cable wire.

Thereby the following advantages are achieved, which are decisive for the invention:

1. Two cables of different wire diameters, e.g. a drop wire cable and a thinner cable wire or conductor, may be terminated to a single terminal element.
2. In the case of both terminated cables resilient lugs defining the slot are deflected independently of each other.

Damage to the narrow contact slots by wires having excessive wire diameter is possible.

An embodiment of the invention therefore provides that two cables having different wire diameters may be terminated to the terminal element. According to a further development of the invention two resilient lugs are formed by the inverted U-slot.

The invention will be explained in detail with reference to the embodiment shown in the accompanying drawing, in which:

FIG. 1 is the terminal element for connecting a drop wire cable and at least one cable conductor, FIG. 2 is a plan view of the terminal element mounted in a terminal strip, and FIG. 3 is a view in the direction of the arrow A of FIG. 2.

As is apparent from FIG. 1, the terminal element 1 is formed with a contact slot 2. The contact slot 2 has an enlarged cascade-like insertion opening 4 with inclined steps in the area where the cable to be terminated will be inserted. A second slot 3 with an overall inverted U-shape extends from the central region of the contact slot 2 towards left and right.

Above this inverted U-slot 3 the contact slot 2 is wider than beneath the mouth of the slot 3.

The wider portion of the contact slot 2, which is defined by resilient lugs **2*b*, 2*c***, serves as a connecting portion for a drop wire cable which has cable diameters of e.g. 0.8 to 1.2 mm.

The narrower lower contact slot portion **2*a*** is used for termination of a cable wire having a wire diameter of e.g. 0.4 to 0.63 mm (previous LSA-PLUS terminals).

The resilient lugs **3*a*, 3*b* between the slot 3 and the lower portion 2*a* of the contact slot may be deflected independently upon termination of the cable wire. When the drop wire cable is terminated in the wider part of the contact slot 2, the resilient lugs 2*b*, 2*c* may also be deflected while this does not result in a loosening of the cable wire in the lower portion 2*a*** of the contact slot.

Thus drop wire cable and cable wire may be terminated essentially independently of each other.

FIGS. 2 and 3 show the terminal element 1 in a known terminal strip 5, in which it is disposed at an angle of 45° to the longitudinal direction of the strip.

From FIG. 3 it is apparent that in the terminal strip 5 a slot 6 has a stepped portion **6*a* resulting in a tapering of the slot in the region 6*b*, whereby the portion 2*a*** of the contact slot is protected from damage by wires having excessive wire diameter.

I claim:

1. A terminal element of leaf-shaped resilient contact material for making a solderless, non-screwed and non-stripping contact, said terminal element comprising:

a first pair of resilient lugs having adjacent side edges arranged in spaced-apart parallel relationship to form a vertically extending, centrally disposed contact slot, said contact slot having an open upper end, the upper portion of said terminal element being provided with an enlarged cascade-like insertion opening communicating with said contact slot upper end;

said terminal element having an inverted, U-shaped second slot having a bight portion extending transversely of and intermediate the ends of said contact slot and a pair of leg portions defining a second pair of resilient lugs having adjacent side edges arranged in spaced-apart parallel relationship;

the portion of said contact slot below said second slot bight portion having a width less than the width of the portion of said contact slot above said second slot bight portion;

whereby said contact slot is adapted to terminate wires of different diameters respectively without interference with the engagement by said terminal element of one terminated wire with the other terminated wire, the width of said contact slot above said second slot bight portion being such that the insulation of wires passing therethrough, to be terminated by the portion of said contact slot below said second slot bight portion, is not pierced sufficiently to result in electrical contact between the wire and said contact slot above said second slot bight portion.

2. The terminal element recited in claim 1, wherein said contact slot is arranged at a 45° angle with respect to the axis of each respective wire which said terminal is adapted to terminate.

3. The terminal element recited in claim 1, wherein said first and second pairs of lugs flex independently of each other when engaging the respective wires in said first and second slots.

4. A terminal element of leaf-shaped resilient contact material for making a solderless, non-screwed and non-stripping contact, said terminal element comprising:

a first pair of resilient lugs having adjacent side edges arranged in spaced parallel relationship defining a first longitudinal contact slot therebetween of a first width, said slot having a cascade-like enlarged insertion opening;

a transverse slot at the bottom of said first contact slot connected to two spaced longitudinal slots thereby forming a U-shaped slot;

a second paid of resilient lugs defined by said U-shaped slot, said lugs having adjacent side edges arranged in spaced parallel relationship forming a second longitudinal contact slot therebetween, said second contact slot aligned and communicating with said first contact slot and having a second width less than said first contact slot width;

said second contact slot being adapted for termination of a wire of one diameter and said first contact slot being adapted for termination of a wire of a larger diameter, the width of said first contact slot being such that the insulation of wires passing therethrough, to be terminated by said second contact slot, is not pierced sufficiently to result in electrical contact between the wire and said first contact slot, said first and second pairs of lugs flexing independently of each other when simultaneously engaging the respective wires therebetween, said terminal element with said first and second slots being arranged at a 45° angle with respect the axis of each respective wire adapted to be terminated.

* * * * *